US006463851B1

(12) United States Patent
König et al.

(10) Patent No.: US 6,463,851 B1
(45) Date of Patent: Oct. 15, 2002

(54) CLAMPING DEVICE FOR LOCKING-UP OR MOUNTING PRINTING FORMS

(75) Inventors: Werner König, Mannheim (DE); Rolf Kündgen, Eppelheim (DE); Gerd Merkel, Dielheim (DE); Bernd Sitzmann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/531,338

(22) Filed: Mar. 20, 2000

(30) Foreign Application Priority Data

Mar. 19, 1999 (DE) ..... 199 12 570

(51) Int. Cl.[7] ..... B41F 27/12
(52) U.S. Cl. ..... 101/415.1; 101/378; 101/481
(58) Field of Search ..... 101/415.1, 409, 101/378, 383, 481, 486, DIG. 36

(56) References Cited

U.S. PATENT DOCUMENTS 3,646,886 A * 3/1972 Woessner et al. ..... 101/378
3,908,546 A * 9/1975 Porter ..... 101/378
5,694,854 A * 12/1997 Becker ..... 101/415.1
5,709,149 A * 1/1998 Weber ..... 101/415.1
2001/0003957 A1 * 6/2001 Konig et al. ..... 101/415.1

FOREIGN PATENT DOCUMENTS

DE 4244279 A1 6/1994
DE 4240333 C2 8/1996

* cited by examiner

*Primary Examiner*—Leslie J. Evanisko
(74) *Attorney, Agent, or Firm*—Laurence A. Greenberg; Werner H. Stemer; Gregory L. Mayback

(57) ABSTRACT

A clamping device for locking-up printing forms on a printing-form cylinder of a printing machine, having a plurality of clamping elements disposed so as to be adjustable in axial direction, with an adjusting device for respectively expanding and buckling a clamped printing-form edge, comprising a shaft whereon the clamping elements, with spring elements interposed, are axially displaceably mounted, and adjusting elements disposed on respective outer ends of the shaft for subjecting the clamping elements to forces acting in the axial direction.

10 Claims, 1 Drawing Sheet

CLAMPING DEVICE FOR LOCKING-UP OR MOUNTING PRINTING FORMS

BACKGROUND OF THE INVENTION

Field of the Invention

The invention relates to a clamping device for locking-up or mounting printing forms on a printing-form cylinder of a printing machine, in particular, a trailing-edge clamping device, having a plurality of clamping elements disposed so as to be adjustable in axial direction, with a setting device for expanding or buckling a clamped printing-form edge.

During printing, where specific print carriers are concerned, the sheets are stretched in a usually trapezoidal manner by moisture and/or fulling actions. This stretching, moreover, increases from one printing unit to the next. In order to achieve register accuracy, therefore, the printing forms must be adapted or matched to the deformation of the sheets. This purpose is served by a device of the aforementioned type.

A device of this general type has become known heretofore from the published German Patent Document DE 42 44 279 A1. In this clamping or lock-up device, an expansion shaft is provided which is axially fixed centrally and is expansible on both sides by outwardly lying setting members. As a result, clamping elements fixedly disposed along the expansion shaft are increasingly displaced outwardly from the inside in order to achieve an expansion or spreading of the printing-plate trailing edge. A disadvantage of this setting device is that very high forces are necessary for expanding the expansion shaft. For the setting or adjusting movement, therefore, a suitable use of tools and a suitable amount of time are required. Furthermore, the high forces must be absorbed in the region of the bearer or Schmitz rings. They lead thereat to deformations which, in turn, impair the accurate and smooth running of the machine. The formlocking or positive connection of the clamping elements to the expansion shaft makes assembly thereof complicated and costly. In this regard, it is noted that a formlocking connection is one which connects two elements together due to the shape of the elements themselves, as opposed to a forcelocking connection, which locks the elements together by force external to the elements. Because the expansion of the expansion shaft is very limited, only a short setting or adjusting travel is possible, so that pronounced roll-outs or stretching of the printer carrier can no longer be corrected.

SUMMARY OF THE INVENTION

It is accordingly an object of the invention to provide a clamping or lock-up device of the type mentioned in the introduction hereto, which avoids the foregoing disadvantages and, in particular, provides sufficient setting or adjusting travel with low forces.

With the foregoing and other objects in view, there is provided, in accordance with the invention, a clamping device for locking-up printing forms on a printing-form cylinder of a printing machine, having a plurality of clamping elements disposed so as to be adjustable in axial direction, with an adjusting device for respectively expanding and buckling a clamped printing-form edge, comprising a shaft whereon the clamping elements, with spring elements interposed, are axially displaceably mounted, and adjusting elements disposed on respective outer ends of the shaft for subjecting the clamping elements to forces acting in the axial direction.

In accordance with another feature of the invention, the shaft has, substantially in the middle thereof, a collar serving at both sides thereof as a stop for clamping and spring elements, respectively.

In accordance with a further feature of the invention, the shaft has an axial bearing in the middle thereof.

In accordance with an added feature of the invention, the axial bearing is axially adjustable and is held in a set position.

In accordance with an additional feature of the invention, the shaft has, substantially in the middle thereof, a contact element extending perpendicularly to the axis of the shaft, the contact element being formed with an opening wherein there engages a setting eccentric mounted in the printing form cylinder.

In accordance with yet another feature of the invention, the axially adjustable axial bearing has springs for bringing the shaft into the middle position when the adjusting elements are loosened.

In accordance with yet a further feature of the invention, the springs are cup springs.

In accordance with yet an added feature of the invention, the adjusting elements are nuts, and the shaft has supports for torques.

In accordance with yet an additional feature of the invention, the spring elements are cup springs.

In accordance with another feature of the invention, the adjusting elements are disposed at both ends of the shaft.

In accordance with a concomitant feature of the invention, the clamping device is a trailing-edge clamping device, wherein the end position of the clamping elements, during the clamping of a printing form on the printing form cylinder by the trailing-edge clamping device, is adjustable in the circumferential direction.

By using the clamping device according to the invention, all types of printing forms, such as printing plates or varnish forms, can be spread or buckled. In addition to avoiding the disadvantages mentioned hereinbefore, the invention offers the advantage that the bearing of the clamping elements and the displacement thereof are functionally separated and do not influence one another. Because the clamping elements are mounted on the shaft so as to be individually rotatable, they can also be adjusted individually, in such a way that it is possible for the printing form to be expanded by sections circumferentially.

According to an expedient development, the shaft has, in the middle thereof, a collar which serves on both sides thereof as a stop for the clamping or spring elements. The printing form can thereby be spread or buckled towards both sides, independently of one another.

An advantageous construction provides for the shaft to have an axial bearing in the middle thereof. This axial bearing is expediently axially adjustable and held in a set position. As a result, displacement is also possible, in addition to the spreading or buckling of the printing form, and a lateral offset can also be corrected. In an exemplary embodiment of this development, the shaft has, in the middle thereof, a contact element extending perpendicularly to the axis of the shaft and defined with an opening wherein there is engaged a setting eccentric mounted in the printing form cylinder. However, other embodiments of the adjusting device are, of course, also possible. Advantageously, the axially adjustable axial mounting has springs which bring the shaft into the middle position when the adjusting elements are loosened. The shaft can thereby be returned in a relatively simple manner to the neutral position which is the correct setting for printer carriers without any lateral offset. The springs are preferably cup springs because of the low axial expansion thereof and the high setting or adjusting force thereof.

In one embodiment of the clamping device, the clamping elements are nuts and the shaft has supports for torques. The nuts run on threads connected to the shaft and subject the clamping elements, together with the spring elements located therebetween, to the corresponding forces. It is thereby possible to achieve a spreading of the printing plate by loosening a nut, and a buckling of the plate by tightening the nut. The support for torques serves to ensure that the actuation of the nuts does not lead to a rotation of the shaft and therefore of the clamping elements. The spring elements may expediently be constructed as cup springs. Although the displacement travels of cup springs are lower than those of compression springs, the cup springs can exert higher forces which are often necessary for the spreading of metal printing plates. The adjusting elements are arranged preferably at both ends of the shaft. Consequently, together with an axial bearing, starting from the middle of the printing plate, spreading or buckling of one side or the other, or spreads or bucklings of varying amounts can be achieved. Instead of the nuts, a greater number of force transmission elements may also be provided, so that higher forces can be achieved.

In an expedient refinement, during the tensioning and clamping of a printing form on the printing form cylinder by the trailing-edge clamping device, the end position of the clamping elements is adjustable in the circumferential direction. By such different end positions of the clamping elements, it is possible to subject a printing form to varying forces, even in the circumferential direction, and therefore to expand it in particular sections or as a whole. This adjustment of the end position of the clamping elements can be performed, for example, by setscrews. However, other possibilities may, of course, also be contemplated. A clamping device is thereby attained, which allows both the spreading and buckling of a printing form and lateral offset and spreading in the circumferential direction. In this way, virtually all possible deformations of the print carrier can be taken into account, and register accuracy can be achieved, even where print carriers presenting serious problems are concerned.

Other features which are considered as characteristic for the invention are set forth in the appended claims.

Although the invention is illustrated and described herein as embodied in a clamping or lock-up device for clamping or mounting printing forms, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
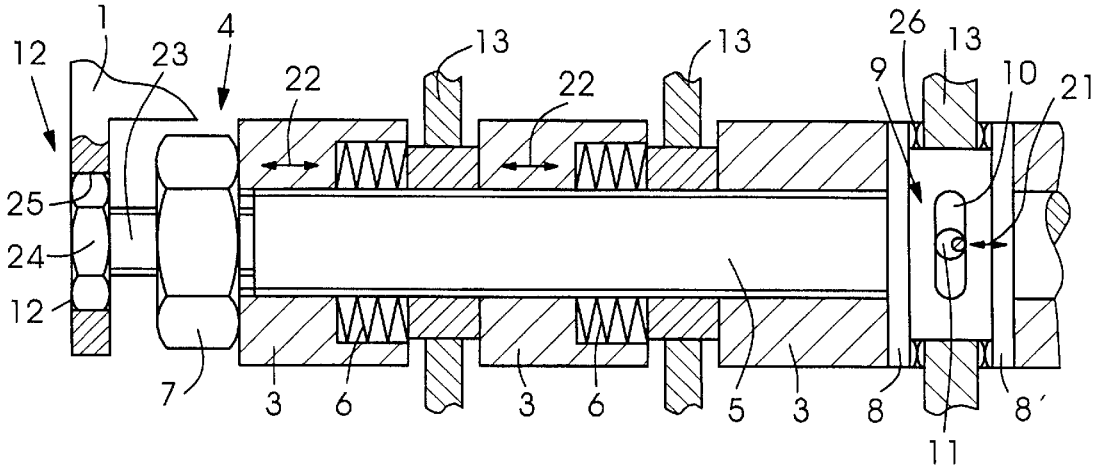
FIG. 1 is a diagrammatic longitudinal sectional view of an exemplary embodiment of the printing-form clamping device according to the invention.

Referring now to the drawings and, first, particularly to FIG. 1 thereof, there is shown therein, in a basic diagram, a clamping or lock-up device according to the invention. Instead of one continuous clamping bar, a plurality of clamping elements 3 are disposed, which serve for receiving a printing form edge. Each of the clamping elements 3 covers one region, for example, a trailing edge 15, of a printing form 14. The clamping elements 3 are disposed axially displaceably on a shaft 5 and spring elements 6, for example cup springs, are located between the clamping elements 3. The shaft 5 is formed at each of the ends thereof with a thread 23, whereon a setting or adjusting element 7, for example, a respective nut, is located. Through the intermediary of these setting devices 4, the clamping elements 3 can be subjected to forces due to compression by the spring elements 6. By tightening a setting element 7, the clamping elements 3 are pushed together and the printing form 14 is caused to buckle, and by loosening or untightening a setting element 7, the clamping elements 3 move apart from one another under the influence of the spring force of the spring elements 6 and the printing form edge 15 stretches or spreads out. The shaft 5 is journalled in the printing form cylinder 1 by bearings 13 and has, in the middle thereof, a collar 8, 8' which ensures the absorption of the forces of the spring elements 6. The clamping elements 3 on each side can thereby be displaced independently of one another. In this case, the non-illustrated righthand side of the clamping device is constructed mirror-symmetrically with the illustrated lefthand side thereof. The possible setting movement of the clamping elements 3 is indicated by the double arrows 22. If the inner clamping element 3 is likewise to be displaced, a spring element 6 would likewise have to be inserted between the latter and the collar 8.

Located at the middle of the shaft 5 is an axial bearing 9. This may be formed by a contact member 10, for example, defining a slot, with a setting or adjusting eccentric 11, the setting eccentric 11 being mounted in the printing form cylinder and having an actuating element. Due to this actuation of the setting eccentric 11, the entire shaft is displacable axially in the direction of the double arrow 21. Compensation can thereby be provided for an axial register offset. The collar 8, 8' may be divided into two parts 8 and 8' in order to accommodate this axial bearing 9. Between the parts 8 and 8' of the collar and the interposed bearing 13 of the shaft 5 in the printing form cylinder 1, springs 26 are disposed, by which the shaft 5 returns to a neutral position thereof automatically when the setting elements 7 are loosened.

A support 12 for torques is arranged at the end of the shaft 5. In this regard, an hexagonal head 24 is located at the end of the thread 23 and engages in a hexagonal socket 25 which is connected to the printing form cylinder 1. In this manner, actuation of the nuts 7 can be performed without rotation of the shaft 5 due to the torques which are exerted. The latter must be avoided so that there is no unintended longitudinal expansion of the printing plate 14. FIG. 1 shows only the operating principles in one possible embodiment, but, of course, features may also be constructed differently, or omitted or otherwise combined. For example, a construction even without the axial bearing 9 would be conceivable, but in that case neither a lateral offset nor an independent setting of the two halves would be possible.

Figure 2:
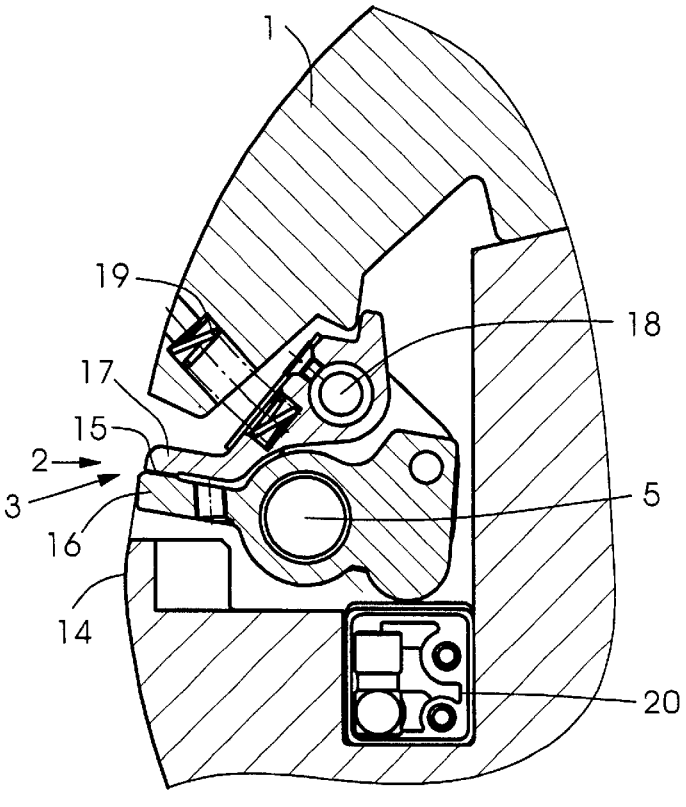
FIG. 2 is a sectional view of a trailing-edge tensioning device taken transversely to the longitudinal axis thereof.

FIG. 2 is a sectional view through a trailing-edge clamping device 2, this sectional view being taken transversely to the longitudinal axis. A trailing-edge clamping device 2 of this type serves also for clamping the trailing edge 15 of a printing form 14 clamped at the leading edge thereof, and for subsequently tensioning or tautening the printing form 14 around the printing form cylinder 1. Generally, a correction to the register accuracy of the printing form 14 must be made at such a trailing edge 15. This applies, in particular, to the expansion or spreading of the trailing edge 15 of a printing form 14 in order to take into account the stretching or out-rolling of the printing carrier during the printing operation. The clamping device according to the invention is therefore provided, generally, for a trailing-edge clamping device 2 of this type.

The trailing-edge clamping device 2 has a clamping or gripping jaw 16 which, in cooperation with a clamping jaw 17, clamps the trailing edge 15 of a printing form 14. After clamping, a pull or tensile force is administered to the printing form 14, thereby tensioning or tautening the latter around the printing form cylinder 1. Simultaneously, a non-illustrated leading-edge clamping device, which likewise holds the printing form 14, is located at the leading edge of the printing form 14.

The described functions of the trailing-edge clamping device 2 are achieved by providing that the shaft 5 be mounted in the printing form cylinder 1, and the clamping elements 3 be disposed on the shaft. These clamping elements 3 are formed, in turn, of gripping jaws 16 and of clamping jaws 17 mounted on the gripping jaws 16 by a shaft 18. A pneumatic cylinder 20 for actuating the trailing-edge clamping device 2 presses against the rear or trailing end of the gripping jaws 16. This setting movement cooperates with a clamping and tensioning spring 19 arranged between the printing form cylinder 1 and the clamping jaw 17. When the pneumatic cylinder 20 moves upwardly, the clamping and tensioning spring 19 is compressed and the trailing-edge clamping device 2 opens. The trailing edge 15 of a printing form 14 can then be inserted, and the pneumatic cylinder 20 moves downwardly, as a result of which, by the clamping and tensioning spring 19, first the clamping jaw 17 closes and, together with the gripping jaw 16, grips the trailing edge 15. When the pneumatic cylinder 20 moves further downwardly, the clamping and tensioning spring 19 imparts the tensioning force in order to tauten the printing form 14. When the printing plate is clamped, the various register corrections can be made in the manner described herein with reference to FIG. 1.

We claim:

1. A clamping device for locking-up printing forms on a printing-forms cylinder of a printing machine, comprising;

a plurality of clamping elements disposed so as to be adjustable in an axial direction; and an adjusting device for respectively expanding and buckling a clamped printing-form edge, said adjusting device including a shaft, spring elements, and adjusting elements, said clamping elements and said spring elements mounted interposed on said shaft for axial displacement of said clamping elements, relative the shaft and said adjusting elements disposed on respective outer ends of said shaft for subjecting said clamping elements to forces acting in the axial direction relative to the shaft.

2. The clamping device according to claim 1, wherein said shaft has, substantially in the middle thereof, a collar serving at both sides thereof as a stop for said clamping and said spring elements, respectively.

3. The clamping device according to claim 1, wherein said shaft has an axial bearing in the middle thereof.

4. The clamping device according to claim 3, wherein said axial bearing is axially adjustable and is held in a set position.

5. The clamping device according to claim 4, wherein said shaft has, substantially in the middle thereof, a contact element for forming said axial bearing extending perpendicularly to the axis of said shaft, said contact element being formed with an opening adapted to a setting eccentric mounted in the printing form cylinder.

6. The clamping device according to claim 4, wherein said axially adjustable axial bearing has springs for bringing said shaft into a middle position when said adjusting elements are loosened.

7. The clamping device according to claim 6, wherein said springs are cup springs.

8. The clamping device according to claim 1, wherein said adjusting elements are nuts, and said shaft has supports for torques.

9. The clamping device according to claim 1, wherein said spring elements are cup springs.

10. The clamping device according to claim 1, being a trailing-edge clamping device, wherein an end position of said clamping elements, during the clamping of printing forms on the printing form cylinder by the trailing-edge clamping device, is adjustable in the circumferential direction.

* * * * *